United States Patent [19]

Tritton et al.

[11] Patent Number: 4,887,855

[45] **Date of Patent: * Dec. 19, 1989**

[54] SHACKLE TYPE SEAL

[75] Inventors: Victor R. Tritton; Gary E. Tritton, both of Pointe Claire; Paul F. Chevillard, Terrebonne, all of Canada

[73] Assignee: Les Enterprises Tritton Ltee, Montreal, Canada

[ * ] Notice: The portion of the term of this patent subsequent to Feb. 12, 2005 has been disclaimed.

[21] Appl. No.: 890,088

[22] Filed: Jul. 24, 1986

[30] Foreign Application Priority Data

Jul. 31, 1985 [CA] Canada ..... 487901

[51] Int. Cl.[4] ..... B65D 55/02

[52] U.S. Cl. ..... 292/307 R; 292/320

[58] Field of Search ..... 24/596; 292/307 R, 315, 292/317–319, 321, 320, 326

[56] References Cited

U.S. PATENT DOCUMENTS

| | | | |
|---|---|---|---|
| 918,570 | 4/1909 | Mather | 292/318 |
| 989,438 | 4/1911 | Stanford | 292/320 |
| 1,038,744 | 9/1912 | Grayson | 292/318 |
| 1,626,273 | 4/1927 | Dietze | 292/318 |
| 1,878,991 | 9/1932 | Murray | 292/320 |
| 1,943,988 | 1/1934 | Peake | 292/318 |
| 1,950,803 | 3/1934 | Lewis | 292/317 |
| 1,964,897 | 7/1934 | Wenk | 292/320 |
| 1,976,089 | 10/1934 | Peake | 292/318 |
| 1,987,351 | 1/1935 | Rose | 292/318 |
| 2,610,879 | 9/1952 | Pope | 292/320 |
| 4,204,709 | 5/1980 | Shea | 292/307 R |
| 4,353,583 | 10/1982 | Moberg | 292/320 |

FOREIGN PATENT DOCUMENTS

| | | | |
|---|---|---|---|
| 272938 | 7/1969 | Austria | 292/317 |

*Primary Examiner*—Lloyd A. Gall

*Attorney, Agent, or Firm*—Brady, O'Boyle & Gates

[57] ABSTRACT

The present invention relates to a shackle-type seal. The seal comprises first and second body portions which enclose a hollow chamber therebetween, and define a shackle leg receiving area adapted to receive a pair of shackle legs. Shackle leg engaging means are provided within the chamber adapted to engage a shackle leg inserted into the chamber. One side portion of the body has a pair of apertures therein in communication with the chamber and each is adapted to receive a shackle leg. At least one of the apertures has stop means therein adapted to prevent egress of a shackle leg therefrom and means are provided for securing of the body portions together to form a seal assembly.

21 Claims, 3 Drawing Sheets

SHACKLE TYPE SEAL

TECHNICAL FIELD

This invention relates to seal assemblies.

More particularly, this invention relates to fields of the type known as "shackle" in which a generally flexible member is adapted to be inserted into a seal body, the shackle enclosing a portion of a device in which it is designed to indicate whether the device, container or the like has been tampered with.

BACKGROUND ART

There are numerous types of seal assemblies known in the art and typical of those are the ones illustrated in U.S. Pat. No. 3,485,521; U.S. Pat. No. 2,020,198; Canadian 187,891, etc. Basically, such seals are used in many different areas of commerce ranging from hydro meters, truck seals, airline equipment seals, etc. whereas opposed to trying to prevent entry into some area or container, the seal is intended to indicate evidence of tampering. With many seals today, particularly those of metal construction, one portion of the seal body is folded onto the other to provide an enclosure; under certain circumstances, this body can be opened without showing any evidence of tampering and consequently defeat the purpose of the seal. In other cases, even when the seal body is intact, by use of small instruments, e.g., hairpins or the like, the shackle can be removed from the seal body, and subsequently closed up, without any apparent evidence of tampering with the seal.

DISCLOSURE OF INVENTION

With this invention, applicant has developed an improved seal structure, which has improved tamper resistance; more particularly, in accordance with this invention, there is provided a seal structure comprising first and second body portions enclosing a hollow chamber therebetween, and defining a shackle leg-receiving area adapted to receive a pair of shackle legs, shackle leg engaging means within the chamber adapted to engage a shackle leg inserted into the chamber, one side portion of the body having a pair of apertures therein in communication with the chamber and each adapted to receive a shackle leg, at least one of the apertures having stop means therein adapted to prevent egress of a shackle leg therefrom and means securing the body portions together to form a seal assembly.

Preferred forms of the present invention are where the seal body is provided with a pair of body members defining therebetween a chamber adapted to receive the legs of a shackle, and in which the body chamber includes shackle leg separation means and means for engaging the shackle leg when the shackle legs are inserted into the body. In this preferred embodiment, the seal assembly, comprised of two portions, is made of a pair of cooperating, mating members, which may be each formed of suitable plastic material by conventional procedures such as, e.g., injection molding, etc. The respective body portions can be of any suitable shape and size, depending on the intended use of the seal. Thus, for example, the body may be of a circular shape, rectangular, cylindrical, etc.

Typically, the body may include a pair of apertures extending from the exterior to the interior of the chamber, each being adapted to permit a shackle leg to pass through the body into the chamber and into engagement with the shackle-leg engaging means. Such apertures will be appropriately dimensioned to receive the shackle legs; typically, they may be of a dimension less than the dimension of the shackle leg which is normally compressible and upon inserting the leg into the body of the seal, the compressive forces are removed permitting the leg to "spring" and engage the appropriate stop means for the shackle leg inside the sealed body.

On the other hand, and again, depending on the nature of the seal, one of the shackle legs may be directly molded in the seal body thus eliminating the need for one aperture. In this case, only a single aperture would be provided permitting the seal to be closed by the remaining shackle leg when it is desired to place the seal in use.

Various types of shackles can be employed with the seals of the present invention and such shackles are known per se in the art. Typically, they consist of a flexible body with a pair of legs normally provided with "hooks" on the end of the legs. Again, the shape of the shackle body will depend on its intended use, and the body or the legs may have various contours for defined uses. Such shackles are normally made of metal, or they can be plastic if desired.

In a particularly preferred embodiment of the present invention, the seal assembly, comprised of a pair of body portions, is made of suitable plastic material capable of being ultrasonically sealed. To this end, the body portions are formed as a pair of cooperating, mating portions which together, when assembled, form a unitary body. At the point where the body portions meet, a minor excess of plastic material may be provided which will seal one body portion to the other upon being subjected to ultrasonic sealing and which in effect, will join the plastic material together without any noticeable line of joinder. Particularly preferred embodiments are where the seal is provided with an upper cover portion and a lower body portion, in which the cover portion is either adapted to seat on or in the lower body portion. In this arrangement, either one or both of the body portions may be provided with a seating surface for the other. As an alternative, the same type of arrangement may be employed but the respective body portions may be closed by heat-welding, adhesives or the like.

Typically, when the seal assembly is manufactured from two or more body portions, one shackle leg may be inserted into the chamber of the body portion prior to joinder of the two body portions together, leaving one free shackle leg for the user to insert through a component. As noted above, a wide variety of materials may be employed for forming the seal of the present invention. These include various types of thermo-plastic and thermo-setting resins, ranging from polyolefins, polycarbonates or the like. Homopolymers or copolymers may be employed as well as mixtures again depending on the properties desired. The body portions may be formed typically by injection molding.

In some embodiments, it may be desirable to provide a seal assembly with a portion having a greater thickness than the thickness of the remainder of the body; in some instances, where a seal is adapted to be used in a situation where the whole body of the seal may be passed through an aperture as a means of avoiding detection of tampering with the contents of, e.g., a container, one wall of the body may be enlarged so as to prevent such an occurrence.

The cover portion of the body may also be provided with at least one extending tab adapted to close off a portion or the majority of an aperture once a shackle leg has been inserted into the seal. Such a tab can be molded integrally with the top or closure member of the body portion; alternately, separate tabs can be employed and once the seal has been either totally or partially assembled, such tabs may be inserted into the remaining aperture of the body to prevent any objects being inserted into the body in an attempt to displace the shackle leg from engagement with its abutting means.

The seals of the present invention find application in a variety of uses; they may be used as electrical meter seals, gas seals, airline seals, and the like. The seals of this invention have a greater tamper resistance than the seals of the prior art and are relatively easy to manufacture and to use.

Having thus generally described the invention, reference will now be made to the accompanying drawings, in which;

DESCRIPTION OF THE PREFERRED EMBODIMENT

Figure 3:
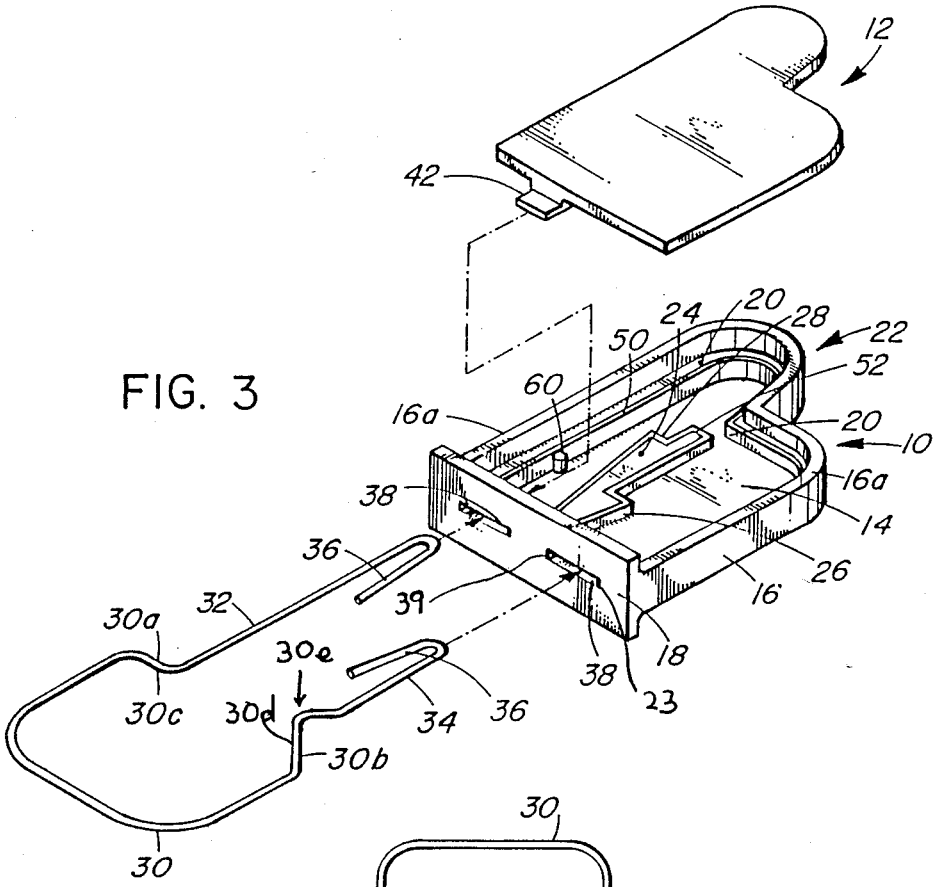
FIG. 3 is a perspective view of the component parts of the seal of FIG. 1, with the shackle not inserted into the seal.
Figure 4:
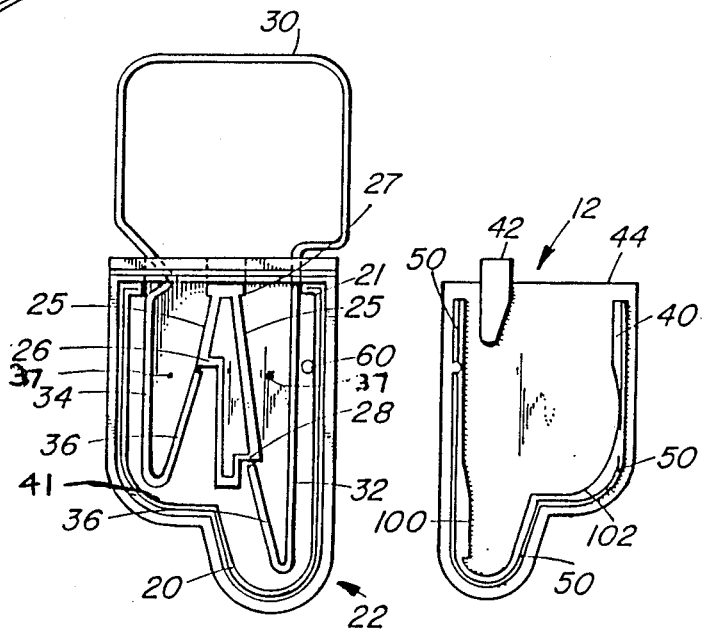
FIG. 4 is a plan view of a seal showing the top portion of the seal removed to illustrate the arrangement of the shackle legs within the body of the seal.

Referring to the drawings in greater detail, and initially to FIGS. 3 and 4 in particular, a seal according to the present invention comprises a pair of body portions which in the embodiment illustrated, comprise a lower body indicated generally by reference number 10 and an upper body or cover portion indicated by reference numeral 12. The lower body portion, in the preferred form illustrated, has a bottom wall 14, a side wall 16 surrounding the bottom wall on all sides thereof except for an end wall which is indicated by reference numeral 18 and which forms the "top" of the seal. The top and bottom portions which together form a seal, are structured so as to provide a mating relationship of one with the other and to this end, again in the embodiment illustrated, the side wall 16 is provided with an inwardly extending shoulder 20 extending about the side wall 16, preferably continuously. This shoulder may also extend adjacent the top or end wall 18 (See FIG.4) to provide a seating surface 21 for the cover portion 12 of the seal assembly. The shoulder 20 is preferably set at a depth so that the cover portion 12, when seated on the shoulder 20, will be flush with the upper portion 16*a* of the side wall 16 when in an assembled position.

The shoulder 20 may further be provided as a stepped surface by virtue of shoulder 50 provided on shoulder 20. With such a stepped shoulder arrangement, some one attempting to insert a tool down the side of the seal would not be able to pass the tool over the shoulder 50 to gain access to the shackle legs within the body.

The seal body 10 as illustrated in the drawings basically defines an enclosure for the shackle legs of the shackle and in one form, that which is illustrated in the drawings, the body is provided with one portion having a greater length than the other. Thus, the body portion 10 is provided with an extension indicated by reference numeral 22 adapted to receive the longer leg of a shackle (described hereinafter), which is normally the shackle leg inserted into the seal by the manufacturer, the other one being left "free" to be inserted by the user of the seal.

The side walls 16, the end wall 18, the top portion 12 form with the bottom 14 of the seal an enclosure, which contains a chamber or cavity for receiving the legs of the shackle. Within the chamber, and located on either wall but as illustrated in FIGS. 3 and 4 located on the bottom wall, there is provided a shackle-leg separation means 24 which is fixedly secured to the bottom of wall 14 and which is raised thereabove. The separation means 24 also provides the function of a shackle leg engaging means and to this end, the member 24 comprises an elevated land having a first recess or shoulder 26 adapted to engage one shackle leg; there is also provided a second recess or shoulder 28 to engage the opposed shackle leg with each shoulder 26 and 28 being spaced from the other by the body portion of the land 24. The height of the land preferably approaches the depth of the cavity or chamber in the lower portion 10 of the seal so that it is dimensioned to prevent a shackle leg from passing over the land 24 when the cover portion 12 is in place.

The cover portion 12 is preferably dimensioned to seat on the shoulder 20 and thus has a general configuration corresponding to the configuration of the lower portion 10 of the seal assembly. On the other hand, if desired, the cover portion 12 may seat on the upper edge 16*a* of the seal assembly by dimensioning the cover portion 12 accordingly; in that embodiment the shoulder 20 would be eliminated and the land 24 would be raised accordingly.

The end wall 18 is preferably dimensioned so as to be wider than the height of the wall 16 of the body for certain applications; in particular, where the seal is used to secure e.g., a cabinet or the like where there is a possibility that the seal body could pass through a slot in the cabinet, the side 18 by having a greater width will prevent that occurring without the necessity of increasing the width of the total body for that purpose.

Various types of shackles can be employed with the seal assembly of the present invention; a typical shackle is shown in the drawings and has a body member 30 and a pair of opposed legs 32 and 34, one of which may be longer as illustrated in the drawings. Again, although various types of leg structures can be employed, a typical leg structure includes a pair of inwardly extending "hook" portions 36 each adapted to engage a shoulder 26 or 28 when inserted into the seal assembly. For this purpose, the end wall 18 is provided with a pair of apertures 38 each dimensioned so as to receive a leg; the apertures 38 actually may be slightly shorter in width than the width of the legs of the shackle with the hooks 36 thereon since due to compression of the hooks 36, an inwardly extending force can be exerted on the hooks to pass through a narrower aperture 38.

From the above, it will be seen that there is thus provided a shackle leg channel 39 extending from the apertures 38 into the body cavity, defined between the separation means 24 and the side walls 16 of the seal body. The channels 39, basically form a receiving area for the shackle leg, as described, and in accordance with this invention, have a lower portion which is contoured as indicated by reference numeral 41, preferably arcuately contoured. This is achieved by providing an appropriately contoured outline to the side wall 16; by providing at least the shackle leg receiving area for the shackle leg which is inserted by the user (but preferably both shackle leg receiving areas) with such a contour, any instrument or tool inserted through the narrow entrances 38 in an attempt to release the shackle leg hook portions from their engagement with the shoulders will normally be deflected by the contoured walls into the central area of the seal body, thereby reducing the potential for tampering with the seal.

The seating surface 21 adjacent end wall 18 preferably extends into the aperture 38, forming an arcuate curved surface 23 provided inside the apertures at the outer edge of each aperture. The arcuate surface 23 forms guide means which aid in insertion of the shackle legs through the apertures and into the body. The angle of curvature of the surface 23 is preferably constant or uniform throughout the surface and can range from 15° to 85°, preferably 25° to 75°, and more preferably 40° to 60°. In use, if some one tampering with the seal broke off the shackle, by virtue of the shackle configuration as discussed hereinafter, and in conjunction with the curved surface in the aperture, the shackle would be broken off flush with the end wall 18, with the remaining portion of the shackle leg still being within the body. The curved surface 23 also, together with the remaining portion of the leg of the shackle, "blocks" off the aperture so that the broken leg could not be reset into the aperture.

A preferred feature of the present invention is also evident from FIGS. 3 and 4 of the drawings, wherein the raised land 24 is provided with outwardly tapering shoulders 25, against which the legs 36 "slide". In this manner, the legs 36 are inwardly compressed as the shackle legs are inserted through the apertures 38 and once passing the shoulders 36 and 28, are permitted then to engage the shoulders.

In conjunction with the above and in accordance with a feature of another embodiment of the present invention, the shackle 30 may also be provided with tapering shoulders **30*a* and 30*b* joining the leg portions 32 and 34 respectively, which are designed to prevent access to the apertures 38 by being positioned a distance from the bottom of the legs such that when the shackle is inserted into the seal (FIG. 4) the inwardly extending shoulders 30*a* and 30*b* are adjacent the upper surface of the wall 18**.

The shackle shoulders **30*a*, 30*b* may also be provided with a line of weakness such as notches 30*c*, 30*d* or the like so that in the event tampering occurs, the shackle would break off along the notches. By providing notches 30*c*, 30*d* at the appropriate location, the shackle will break off flush with the end wall 18**, leaving the remaining portions of the legs within the body and basically preventing any further tampering with the device. If desired more than one notch could be provided on each shoulder.

As will be seen from FIG. 3, shoulders **30*a* and 30*b* may be provided with differing configurations. Leg 34 for example has a somewhat V-shaped portion constituted in part by shoulder 30*b*. Upon insertion into the body of the seal, portion 30*e* of the V-shaped configuration will abut the inside surface 39 of the aperture, thus, substantially blocking access to the entrance aperture 38 and thereby preventing an attempt to compress the hook portion 36 towards the leg 34** to remove the shackle from the seal.

Leg 32, in the illustrated embodiment, is of a configuration such that shoulder **30*a* is closely adjacent the upper surface of wall 18 and leaves little room for trying to gain access between the wall 18 and shoulder 30*a***.

In an alternative embodiment, the shackle could be provided with outwardly directed hook portions 36 with a suitable shoulder arrangement for engagement with the hook being provided along the inner surface of side wall 16.

A still further arrangement is wherein the raised land portion 24 is provided on the cover member 12.

The cover portion 12 may also have the structure illustrated in greater detail in FIG. 4 as to the side mating with the body portion 10 of the seal assembly. In this particular arrangement, the cover portion 12 may be provided with a downwardly extending shoulder 40 which preferably extends about the inner circumference of the cover and which may be dimensioned to seat on the shoulder 20 of the body portion 10. In this manner, the thickness of the cover portion can be reduced.

Figure 1:
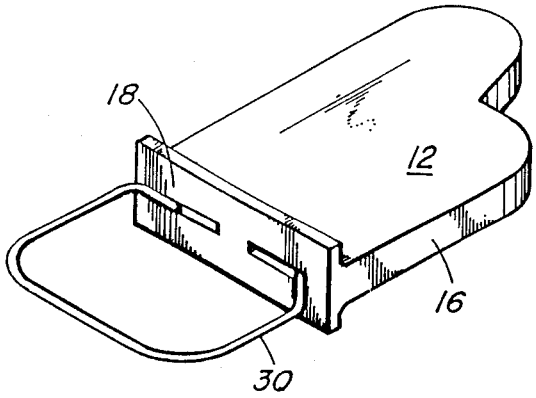
FIG. 1 is a perspective view of a seal according to the present invention shown together with a shackle and in which the shackle legs are inserted into the seal.
Figure 2:
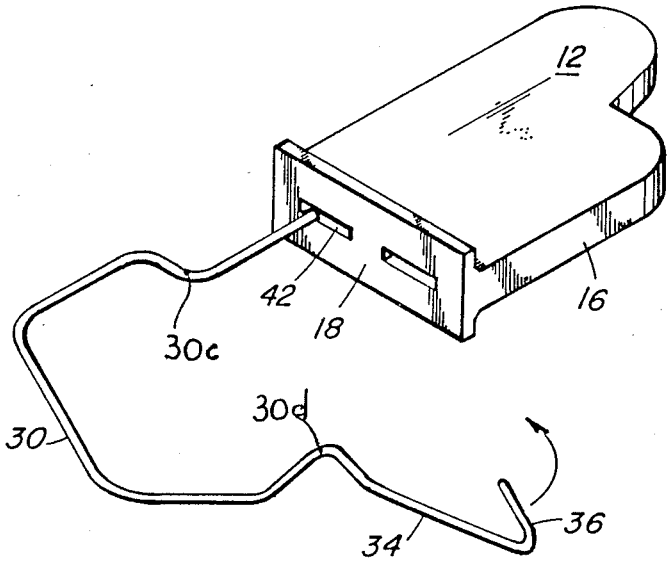
FIG. 2 is a perspective view similar to FIG. 1 but showing the seal prior to insertion of one shackle leg (the other already having been inserted) into the seal.

As illustrated in FIGS. 3 and 4, the cover 12 may also be provided with a projecting tab 42, fixedly secured to the inner portion of the cover, and which extends beyond the upper wall or edge 44. This tab 42 may be dimensioned so as to pass through the aperture 38 and terminate at the exterior of the end wall 18. Tab 42 is designed to prevent access to the aperture 38 once the shackle leg as been inserted in that portion of the seal; normally, during assembly, one shackle leg 32 will be inserted into the seal, with the cover portion 12 then being seated in the body portion with the tab 42 projecting into the aperture 38 to form the arrangement shown in FIGS. 1 and 2.

Tab 42 may be provided as a separate component which could be ultrasonically or otherwise sealed in place.

Cover portion 12 may also be provided with build-ups 100 and 102 which act to steer or guide the wire shackle towards the central land arrangement for engagement therewith.

In many cases, the seals of the present invention will be formed of appropriate plastic material chosen for individual applications; in one embodiment of the present invention, such plastic seals will be assembled using various types of adhesives or, for the embodiments particularly illustrated in FIGS. 3 and 4, the cover and body portions of the seal assembly may be sealed ultrasonically using conventional equipment which will provide a more secure seal assembly for many applications. To this end, certain portions of the body and cover members may be provided with a small ridge of plastic material seen in FIGS. 3 and 4 and designated generally by reference numeral 50, on those parts of the seal which are in mating contact with each other. Thus, for example, on the cover assembly a bead 50 of the plastic material (the balance of the seal likewise being made of the same or similar plastic material) is located on the downwardly extending shoulder 40; on the body portion, the ridge 50 may extend about the shoulder 20 and further, there may be provided a ridge or bead of plastic material 52 on the raised land portion 24 so that when the cover and bottom members are placed in juxtaposition with each other, and then subjected to ultrasonic sealing, the ridge or beads 50 and 52 will melt and secure the touching portions together in a very strong bond. As seen from FIG. 4, a guide 60 may be employed for guiding the leg 32 into the proper area of the body, when it is inserted.

Alternatively, it will be appreciated that appropriate glue, adhesive or other suitable means for securing the cover and body portions together may be employed as is conventionally available to those skilled in the art.

Preferably, in use, the front of the seal is constituted by the side where cover portion 12 has been secured to body 10 so that if tampering is attempted through the sealed joint, this would be readily evident on the front of the seal.

In assembly, as indicated above, the cover and body members are placed in juxtaposition, normally after one leg of the shackle assembly is inserted into the seal with the hook 36 being placed onto the channel adjacent shoulder 25; this may also engage notch 27. The seals are thus distributed in a manner illustrated in FIG. 2 so that the user merely places the body 30 of the shackle about the item to be secured, and then by inwardly bending the leg 34 into the aperture 38 and downwardly forcing the same into the locking position with the shoulder 26, a permanent connection is made.

Figure 3A:
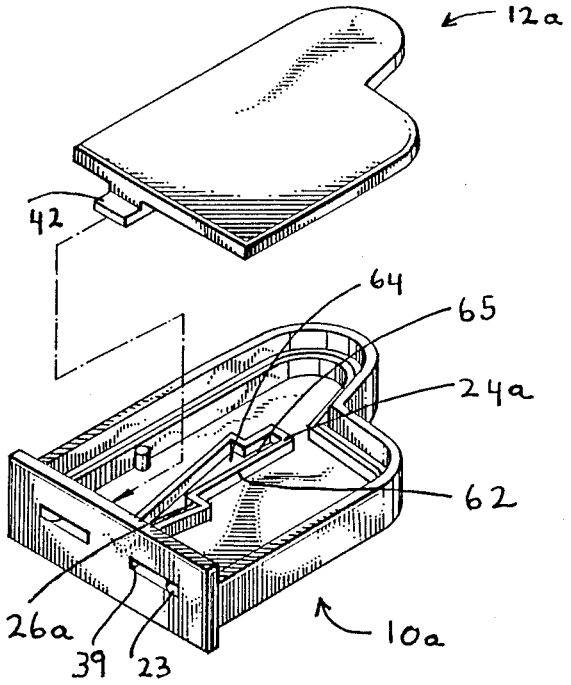
FIG. 3*a* is a perspective view of a second embodiment of the lower body of a seal according to the present invention.
Figure 3B:
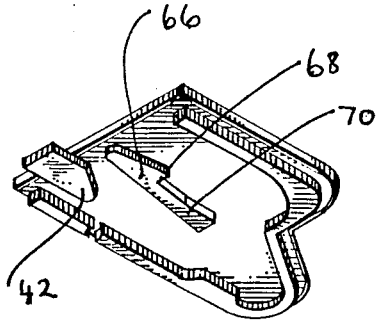
FIG. 3*b* is a perspective view of a cover portion suitable for use with the lower body illustrated in FIG. 3*a*.

In FIGS. 3*a* and 3*b*, there is illustrated an alternative embodiment for the body of the seal. In this embodiment, the land portion 24*a* of the lower body portion 10*a* is of the same general configuration (except as described herein) as that of land portion 24 of FIGS. 3 and 4. However, in the case of FIG. 3*a*, the land portion 24*a* has an outer peripheral raised edge 62 defining the land portion 24*a*. Within the raised edge 62, the land 24 comprises a recessed cavity 64 for receiving a mating component associated with the cover portion 12*a*.

Cover portion 12*a*, as shown in FIG. 3*b*, comprises a mating or cooperating tab or member 66. Member 66 comprises an enlarged portion at one end forming shoulder 68 and elongated narrower portion 70. As will be appreciated, member 66 is dimensioned so as to fit within cavity 64 of lower body portion 10*a* so that shoulder 68 engages the inner surface 26*a* and elongated portion 70 seats within its corresponding portion in cavity 64. In this respect, the end portion 65 may be made solid to fill-up that area not otherwise occupied by the member 66. If desired, a bead of plastic material, (not shown), may be provided on cooperating member 66 so that when the seal is subjected to ultrasonic sealing, the bead will melt and secure the member 66 within the cavity 64.

It will be understood that various modifications can be made to the above described embodiments without departing from the spirit and scope of the invention herein.

We claim:

1. A shackle type seal comprising first and second body portions enclosing a hollow chamber therebetween, and defining a shackle leg-receiving area adapted to receive a pair of shackle legs, shackle leg engaging means within said chamber adapted to engage a shackle leg inserted into said chamber, at least one aperture in an end surface of said body in communication with said chamber and adapted to receive a shackle leg therethrough, stop means on one of said body portions adapted for insertion into said aperture to prevent access through said aperture and egress of a shackle leg therefrom after insertion into said chamber, and means securing said body portions together to form a seal assembly.

2. A shackle-type seal as claimed in claim 1, said at least one aperture including an arcuate curved surface extending through said aperture.

3. A shackle adapted for use in a seal as defined in claim 1 comprising a body portion having first and second spaced apart opposed leg members extending therefrom, each of said leg members having a hook-shaped free end, one of said leg members having a greater length than the other of said leg members, said shackle being provided with a line of weakness in the proximity of the point where said body and said leg members meet.

4. A shackle-type seal having a two piece plastic seal body comprising mating top and bottom sections sealable together by, for example, ultrasonic means, said top and bottom sections having a body cavity therebetween, a pair of spaced-apart narrow entrance apertures at one end of said body, each adapted to permit entry of a shackle leg, centrally disposed shackle leg engaging means within said body cavity, a shackle leg channel extending from each of said entrance apertures into said body cavity, each channel being adjacent to said centrally disposed engaging means and to permit passage of a shackle leg therethrough, said body cavity having a contoured shackle leg receiving area at a terminal end of one of said shackle leg channels with said contoured receiving area being adapted to deflect any instrument passed through said entrance aperture into said channel, stop means for inserting into at least one of said apertures to prevent egress of a shackle leg therefrom, said stop means comprising a tab extending from one of said body sections.

5. A shackle-type seal, as defined in claim 1, wherein each of said channels has an arcuately contoured shackle leg receiving area at the terminal end of each channel.

6. A shackle-type seal as defined in claim 5, wherein at least one of said top and bottom sections includes a bead of plastic material associated therewith adapted to permit ultrasonic sealing of one section to another section.

7. A shackle-type seal, as defined in claim 5, wherein one of said shackle leg channels has a greater length than the other with one of said arcuately contoured shackle leg receiving areas being positioned in said body at a greater distance from said apertures than the other leg receiving area.

8. A shackle-type seal as defined in claim 7, wherein said centrally disposed shackle leg engaging means comprises a raised land portion having first and second spaced-apart shoulders adapted for engagement with a respective shackle leg.

9. A shackle-type seal as defined in claim 4, wherein at least one of said entrance apertures includes an arcuately curved entrance surface extending into said aperture.

10. A shackle-type seal as defined in claim 4, wherein said body sections comprise first and second body portions, said first body portion comprising a bottom wall, a side wall extending upwardly from said bottom wall and surrounding said bottom wall, and an end wall having said entrance apertures therein, said second body portion being adapted for seating engagement on the side wall of said first body portion.

11. A shackle-type seal as defined in claim 10, wherein said first body portion includes a shoulder extending at least partially around said side wall and being adjacent to and of a lesser height than said side wall, and said second body portion being adapted to seat on said shoulder of said first body portion.

12. In a shackle adapted for use in a seal of the type of claim 1 where the shackle has a body portion with first and second spaced apart opposed leg members extending therefrom, with each of the leg members having a hook-shaped end portion, the improvement wherein said body portion has a pair of spaced apart arms connected to said legs, at least one of said arms extending inwardly at a point spaced from said hook-shaped portion, said arm having said inwardly extending portion being adapted to be located adjacent an entrance aperture of a seal body whereby said inwardly extending portion is adapted to at least partially block said entrance when said shackle leg is inserted into a seal.

13. The shackle of claim 12, wherein each shackle leg has an inwardly extending portion extending inwardly towards the opposed leg.

14. The shackle of claim 12, wherein said shackle is provided with a line of weakness proximate of the point where the shackle leg is adapted to meet the body of the seal.

15. A shackle-type seal having a two-piece plastic seal body 15 sealable by, for example, ultrasonic means and having mating top and bottom sections with a body cavity therebetween, a pair of spaced apart narrow entrance apertures at one end of said body, each adapted to permit entry of a shackle leg of a shackle, centrally disposed shackle-leg engaging means within said body cavity, a shackle leg channel extending from said entrance apertures into said body cavity and being proximate to said centrally disposed engaging means, said body cavity having a lower contoured shackle leg area at the terminal end of said shackle leg channel with said contoured area being arranged to deflect any instrument passed through said entrance apertures and into said channels, and stop means for inserting into at least one of said apertures to prevent egress of a shackle leg therefrom, said stop means comprising a tab extending from one of said top and bottom sections.

16. The two piece seal of claim 15, wherein each shackle leg channel is provided with a lower contoured shackle leg area at the terminal end.

17. The two piece seal of claim 15, wherein said lower contoured shackle leg area has an arcuately configured outline.

18. A shackle-type seal comprising a first body portion and a second body portion adapted to mate and cooperate with said first body portion, said first body portion comprising a bottom wall, a side wall extending upwardly from said bottom wall and surrounding said bottom wall and an end wall having a pair of apertures extending therethrough, shackle leg-engaging means being provided on said bottom wall, said second body portion being adapted for seating engagement said side wall of said first body portion and including a tab member adapted for insertion into at least one of said apertures to prevent access through said aperture and egress of a shackle leg after insertion into said chamber.

19. A shackle-type seal as claimed in claim 18, shackle leg-engaging means being provided on at least one of said first or second body portions, said second body portion being adapted for seating engagement on said side wall of said first body portion, said first body portion including a shoulder extending at least partially around said side wall and being adjacent to and of lesser height than said side wall and said second body portion including a projecting shoulder for seating engagement with said shoulder of said first body portion.

20. A shackle-type seal as claimed in claim 18, said first and second body portions defining a hollow chamber; said shackle leg-engaging means comprising leg separation means positioned centrally of said chamber and extending into said chamber from said end wall, said apertures being positioned one on each side of said leg separation means; said leg separation means having opposite edges extending from said end wall and inclined outwardly relative to each other; and a detent formed in each said edge.

21. A shackle-type seal as claimed in claim 20, including a first detent in one of said edges and a second detent in the other of said edges, said first detent being closer to said end wall than said second detent.

* * * * *